United States Patent [19]

Gardner et al.

[11] Patent Number: 4,809,684

[45] Date of Patent: Mar. 7, 1989

[54] PRESSURE APPLIANCE FOR THE HAND FOR AIDING CIRCULATION

[75] Inventors: Arthur M. N. Gardner; Roger H. Fox, both of Devon, United Kingdom

[73] Assignee: Novamedix Limited, Hampshire, United Kingdom

[21] Appl. No.: 209,276

[22] Filed: May 31, 1988

Related U.S. Application Data

[63] Continuation-in-part of Ser. No. 100,318, Sep. 23, 1987, which is a continuation of Ser. No. 809,590, Dec. 16, 1985, abandoned.

[51] Int. Cl.[4] ..... A61H 9/00

[52] U.S. Cl. ..... 128/64; 128/24 R

[58] Field of Search ..... 128/24 R, 64, 77, 87 R, 128/87 A

[56] References Cited

U.S. PATENT DOCUMENTS

| | | | |
|---|---|---|---|
| Re. 26,046 | 6/1966 | Gottfried | 128/87 R |
| 1,608,239 | 11/1926 | Rosett | 128/24 R |
| 2,781,041 | 2/1957 | Weinberg | 128/24 R |
| 3,153,413 | 10/1964 | Gottfried | 128/64 |
| 3,186,404 | 6/1965 | Gardner | 128/64 |
| 3,286,711 | 11/1966 | MacLeod | 128/40 |
| 3,338,237 | 8/1967 | Scence | 128/87 R |
| 3,450,450 | 6/1969 | Hopkins et al. | 128/38 |
| 3,454,010 | 7/1969 | Lilligren et al. | 128/24 R |
| 3,859,989 | 1/1975 | Spielberg | 128/24 R |
| 3,892,229 | 7/1975 | Taylor et al. | 128/64 |
| 3,901,221 | 9/1975 | Nicholson et al. | 128/24 R |
| 3,908,642 | 9/1975 | Vinmont | 128/40 |
| 3,942,518 | 3/1976 | Tentarrs et al. | 128/64 |
| 4,388,919 | 6/1983 | Benjamin, Jr. et al. | 128/64 |
| 4,396,010 | 8/1983 | Arkans | 128/24 R |
| 4,418,690 | 12/1983 | Mummert | 128/24 R |
| 4,624,244 | 11/1986 | Taheri | 128/24 R |
| 4,706,658 | 11/1987 | Cronin | 128/77 |
| 4,709,694 | 12/1987 | O'Connell | 128/77 |
| 4,866,084 | 1/1978 | Tillender | 128/24 R |

FOREIGN PATENT DOCUMENTS

| | | | |
|---|---|---|---|
| 2345992 | 10/1977 | France | 128/24 R |
| 2425239 | 1/1980 | France | 128/24 R |
| 1310492 | 3/1973 | United Kingdom | 128/24 R |

*Primary Examiner*—Edgar S. Burr
*Assistant Examiner*—Tonya Lamb
*Attorney, Agent, or Firm*—Hopgood, Calimafde, Kalil, Blaustein & Judlowe

[57] ABSTRACT

Device and method for venous-flow stimulation, through localized periodic application of squeezing forces, essentially limited to the phalanx of the digits and thumb, and to the adjacent region of the palm of the hand. To this end, an inflatable mitt is applied to the said phalanx and adjacent regions, with digits and thumb projecting beyond the mitt. The mitt may be wrapped with suitable fabric, such as surgical gauze or muslin, to provide a circumferential tie of the inflatable regions, the tie providing hoop-tension reference for inward application of a squeezing pressure/release cycle; and the squeeze is applied in unison circumferentially around each of the individual digits (and thumb) at the phalanx region. Altervatively, the inflatable mitt may be embedded in an orthopedic cast, without impairing the application of pulsed pressure local to the indicated region in this case the circumferential tie is provided by the case. In either case, arterial throughput is also noted, concurrent with such venous-flow stimulation, and the arterial throughput is enhanced when the stimulating pulse is sustained for a brief period prior to a relaxation dwell between pulses.

27 Claims, 5 Drawing Sheets

PRESSURE APPLIANCE FOR THE HAND FOR AIDING CIRCULATION

RELATED CASE

This application is a continuation-in-part of our copending application Ser. No. 100,318, filed Sept. 23, 1987, and said copending application is a continuation of application Ser. No. 809,590, filed Dec. 16, 1985 (now abandoned).

BACKGROUND OF THE INVENTION

This invention relates to a medical appliance, and particularly to an appliance for applying local pressure to a part of the hand for the purpose of stimulating blood circulation through enhanced venous-return flow.

Such medical appliances are known which comprise a double-walled sheath adapted to fit over a limb, for example, an arm or a calf and foot to be treated, and a pump apparatus arranged to inflate and deflate the sheath cyclically, thereby to apply a pumping action to the limb and thus assist venous blood-flow therein.

A particular disadvantage of such known devices is that they cannot be used when the limb to be treated is also to be encased in a plaster cast. Also, they are of inherently large-volume capacity with large area coverage of the involved limb, so that their action is on an entire limb; large-capacity pumping apparatus is required for administration of an inflation/deflation cycle, and more than one pump region may be activated simultaneously, to the detriment of achieving optimum venous-return flow. In particular, these known devices do not permit localized application of pumping pressures.

In our U.S. Pat. No. 4,614,180, we disclose a variety of inflatable devices of relatively low volumetric capacity and specifically adapted to stimulate venous-return flow in a human leg, by localized action beneath the mid-tarsal region of the foot, whereby a major locale of blood accumulation is periodically squeezed, to force or to enhance the force of venous-return flow. The local nature of these inflatable devices enables them to be encased in a cast if necessary, and the toes are always exposed, thus permitting inspection of circulation, swelling, nerve-reaction and other indicia of treatment progress.

BRIEF STATEMENT OF THE INVENTION

We have discovered a venous-pump mechanism in the region of the hand which is essentially limited to the proximal phalanges of the digits and thumb, and to the adjacent region of the palm; this mechanism is naturally brought into operation upon a tight doubling of the fist, whereupon venous-return flow ensues from the entire arm. A tight fist squeezes this region, which is a major locale of blood accumulation, i.e., in readiness for venous return through the arm. And we have established that by periodically squeezing this region without requiring a patient to double his fist, i.e., by external application of squeezing pressure essentially local to this region, venous-return flow may be efficiently stimulated, even in the case of a degree of venous obstruction in the wrist or elsewhere in the involved arm. Additionally, we have discovered that such externally applied squeezing pressure can also be accompanied by an improvement in arterial flow in the involved arm.

It is accordingly an object of the invention to provide an improved method and means of stimulating the flow of blood in a human arm.

It is a specific object to provide means whereby periodic application of pressure to a relatively limited and localized region of the hand may efficiently stimulate or assist the venous-return flow in the involved arm.

It is another specific object to meet the above objects with structure which will permit continuous exposure of the extremities of the thumb and digits of the involved hand, without interrupting or disturbing the therapy involved in the periodic application of pressure.

The invention achieves the above objects by localizing the periodic application of squeezing force, essentially limited to the phalanx of the digits and thumb, and to the adjacent region of the palm of the hand. To this end, and for the embodiments to be described, an inflatable mitt is applied to the said proximal phalanges and adjacent regions, with extremities of digits and thumb projecting beyond the mitt. The mitt may be wrapped with suitable fabric, such as surgical gauze or muslin, to provide a circumferential tie of the inflatable regions, the tie providing hoop-tension reference for inward application of a squeezing pressure/release cycle; and the squeeze is applied in unison circumferentially around each of the individual digits (and thumb) at the phalanx region. Alternatively, the inflatable device may be a bag having an active surface which will conform generally to that region of the palm which is near adjacent phalanges of the digits of the hand, bag-inflation being limited by a circumferential tie which peripherally envelops essentially only said region. Further, the inflatable mitt or bag device may be embedded in an orthopedic cast, without impairing the application of pulsed pressure local to the indicated region; in this case, the circumferential tie is provided by the cast.

DETAILED DESCRIPTION

The invention will be described in detail for various embodiments, in conjunction with the accompanying drawings, in which.

Figure 3:
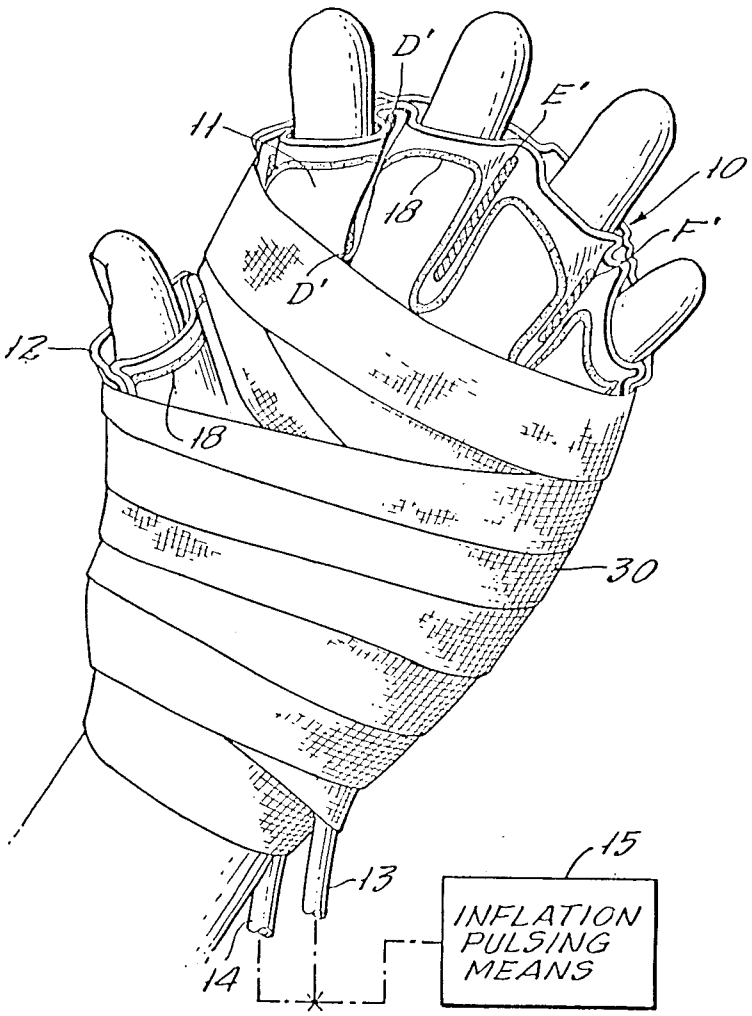
FIG. 3 is a view similar to FIG. 1, after wrapping with gauze or muslin, and therefore in readiness for therapeutic use.
Figure 1:
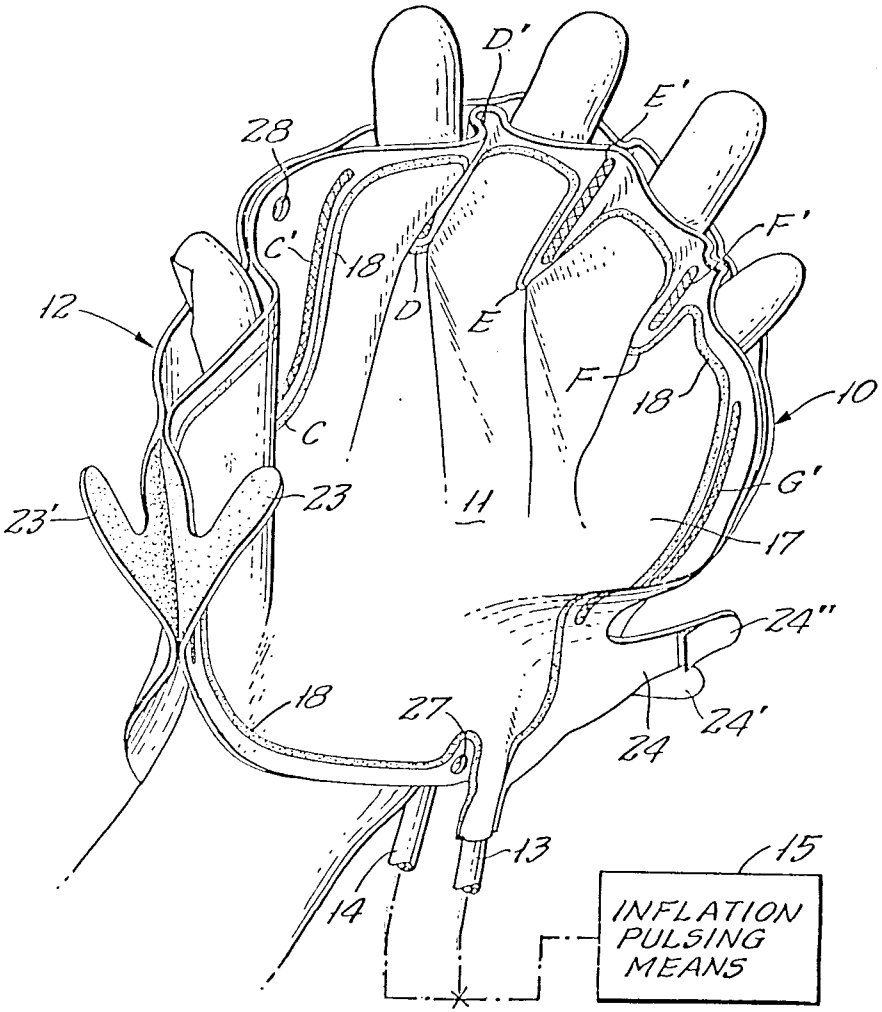
FIG. 1 is generally a plan view, looking at the palm side of a hand which has been inserted into an inflatable mitt of the invention.
Figure 2:
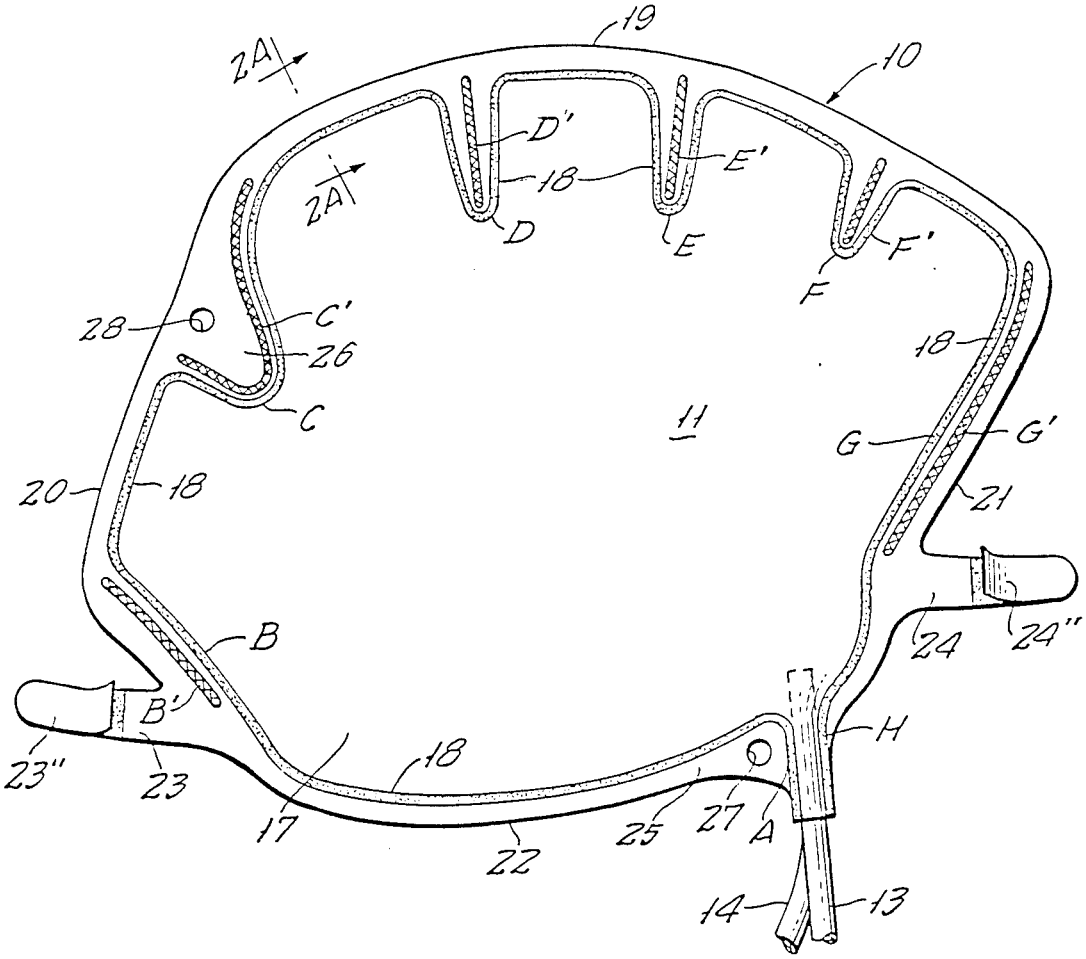
FIG. 2 is a plan view of the mitt of FIG. 1, in flattened condition prior to hand insertion.
Figure 7:
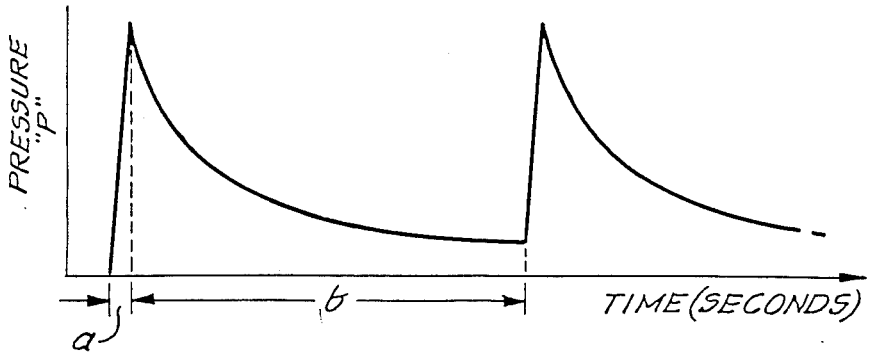
FIGS. 7 and 7A are simple graphs or pressure as a function of time, in aid of discussion of uses of the invention.

Referring initially to FIGS. 1 to 3, the invention is shown in application to an inflatable mitt 10 which comprises two like inflatable bags 11-12 of flexible material, secured to each other only at certain points, and each of the bags is served by its own pipe or supply connection 13-14. These connections 13-14 are in turn served in unison by a single pumping apparatus 15, with sufficient capacity and control to deliver pressure fluid with full application of squeezing pressure to the hand-pump region of the hand, within two seconds, preferably one second or less, as will be more fully discussed in connection with FIG. 7. The pressure fluid is suitably air.

The bags 11-12 may be image duplicates of each other. As shown, bag 11 comprises inner and outer panels 16-17 of like peripheral contour bonded continuously around the periphery and to the pressure-fluid connection tube 13. A continuous heat seal, indented by, reason of local compression for greater reinforcement of the bonding, follows a peripheral course 18, which is delineated by stippling in the drawing.

The blank to which each of the panels 16-17 is cut follows a forward or distal contour 19 which is designed to lap the first phalanges bones and, generally speaking, conforms to the alignment of the joints between first and second phalanges bones for a flattened hand, so that both panels 16-17 cover the phalanx of the digits of the hand (i.e., the first phalanges bones of all digits). The forward contour 19 merges with a thumb-side or lateral contour 20 which laps or traverses the joint between the phalanges of the thumb; the forward contour 19 merges at its other end with an opposite-side or lateral contour 21 which extends to proximal-lateral juncture with the supply tube 13; and both lateral contours 20-21 merge with a proximal transverse contour 22 which also extends to proximal-lateral juncture with tube 13. As shown, bonded tab formations 23-24 of panels 16-17 extend in laterally opposite directions from proximal regions of the lateral contours 20-21.

The peripheral course 18 of the continuous reinforcing seal of panels 16-17 is characterized by limited longitudinal adjacency to pipe 13 at A (FIG. 2), truncation of tab 23 at B, a first inward lobe at C between thumb and forefinger locations, similar but more narrow lobes at D-E-F between adjacent digits, truncation of tab 24 at G, and finally by limited longitudinal adjacency to pipe 13 at H. Small triangular fillet areas 25-26 near region A and between seal 18 and proximal contour 22, and between lobe C and lateral contour 20, are shown with apertures 27-28 which will be understood to provide alignment registry with jig pins (not shown) for production assembly of the panels 16-17 prior to and during bonding and sealing steps of manufacture.

Figure 2A:
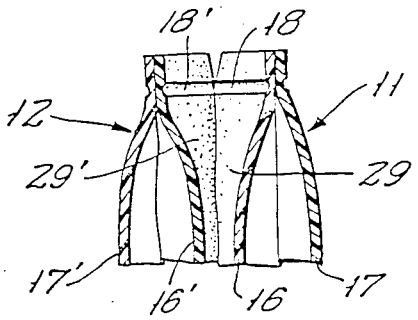
FIG. 2A is a fragmentary sectional view taken at 2A—2A in FIG. 2, for an expanded-mitt condition.

The inner panel 16 may be of porous material or may be perforated for limited escape of inflation fluid during intervals between pulsed inflation, thus producing a cooling action upon adjacent skin; and as a further comfort to the patient, the skin-contacting surface of panel 16 is preferably flock-coated, as suggested by stippling at 29 in FIG. 2A.

As indicated above, the other bag 12 may be of construction identical to that of bag 11; however, for the case of a flock-coated skin-contacting surface 29' of bag 12, the construction identity is a mirror-image identity. Corresponding parts of bag 12 are given the same number identification as for bag 11, but with primed notation.

The mitt 10 becomes a unitary article upon bringing both bags 11-12 into mirror-image adjacency and registration of locating apertures 27-28 of the respective bags. Thus registered, compression heat-sealing is effected marginally outside the seal course 18, locally at B', and at C', D', E', F', and G', thus establishing intervening unsealed peripheral spaces (between bags 11-12), which spaces enable individual thumb and digit passage, to develop the inserted-hand condition of FIG. 1. It will be understood that the span between adjacent distal ends of seals B'-C' must be sufficient for circumferential embrace of the thumb, while the spans between adjacent distal ends of seals C'-D', of seals D'-E', of seals E'-F', and of F'-G', must also be sufficient for circumferential embrace of the respective digits which individually pass therethrough.

In use, the mitt of FIGS. 1 to 3, is selected for size appropriate to the hand size and hand condition of the patient. For example, a severely swollen hand may call for a mitt of larger size than the patient might otherwise require. Upon hand insertion, the appearance will be as depicted in FIG. 1, with sealed alignments C'-D'-E'-F' extending deep into each crotch between the thumb and the forefinger and between adjacent digits. Next, the tabs 23-24 of bag 11 are drawn toward each other and are adhesively secured to panel 17, as by first removing local protective strips 23''-24'' to expose a local coat of pressure-sensitive adhesive, and then drawing the tab inwardly to effectively narrow the proximal or wrist-end opening of the mitt. A similar local fastening of corresponding tabs 23'-24' of bag 12 to the outer panel 17' of bag 12 will aid in adapting the wrist opening to the patient. A circumferential tie may then be developed by orthopedic-cast techniques, if necessary around all or part of the mitt, making sure that the tube connections 13-14 become externally accessible for service connection to the inflation pulsing means 15. In the form shown, however, it is assumed that a cast is not necessary, at least in the region of the mitt, and in FIG. 3 it is illustrated that surgical gauze or muslin 30 may be wrapped around the palm and dorsum and over the phalanx region of the digits and thumb, thus establishing a circumferential tie around the hand-pump region; alternatively, if the outer panels 17-17' of bags 11-12 are of relatively non-stretch material, these panels 17-17' may in some cases provide a sufficient circumferential tie.

The circumferential tie will be understood to effectively confine bags 16-17 against outward expansion in the inflation/deflation cycle, and at the same time to substantially limit the volumetric requirements for recycled supply of pressure fluid in the inflation/deflation cycle. As a practical matter, squeezing pressure, at the phalanx, is effectively localized to the circumference of the thumb, to the circumference of each digit, and to adjacent regions of the palm and dorsum of the hand, and all vein accumulations of blood within this limited (phalanx and adjacent palm) region are constricted simultaneously, in imitation of a clenched-fist actuation of the hand pump. Importantly, the thumb and all digits remain exposed, as for periodic inspection of circulation, for nerve-reaction testing, and for inspection of therapeutic progress in reduction of swelling.

Figure 4:
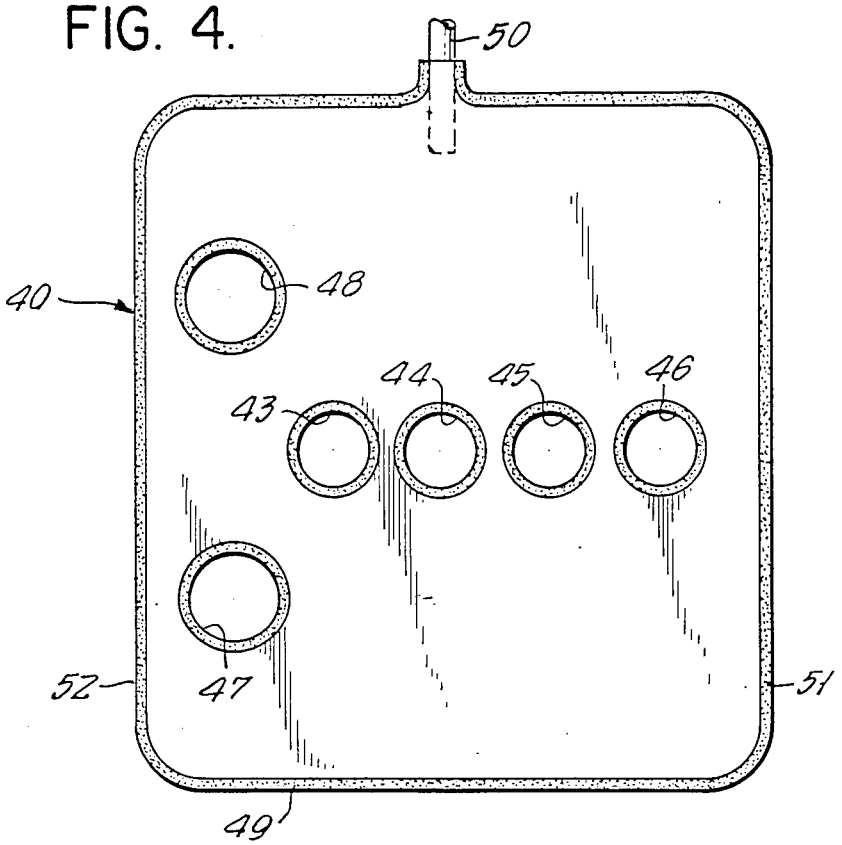
FIG. 4 is a plan view of another inflatable embodiment, in flattened condition, prior to use.
Figure 5:
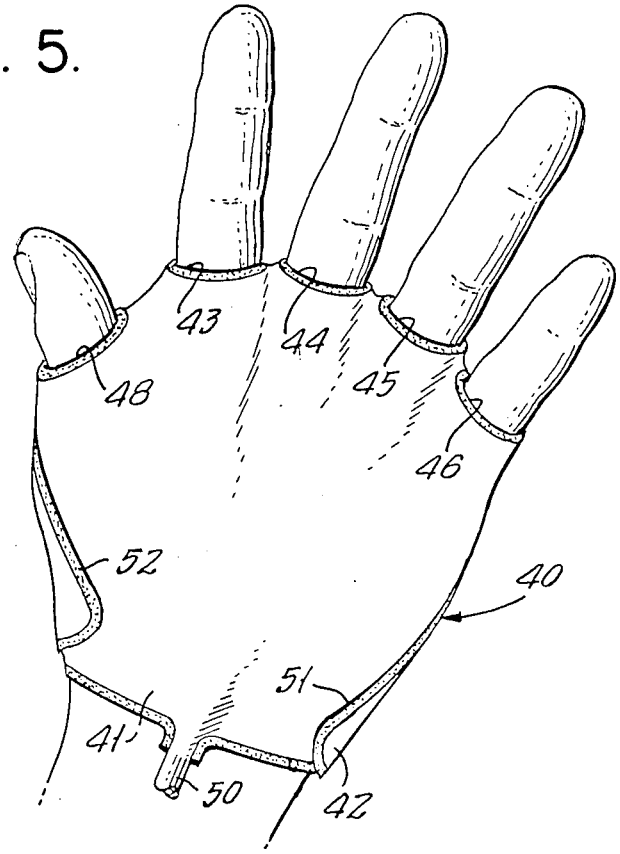
FIG. 5 is a view similar to FIG. 1 but for the purpose of showing hand insertion in the embodiment of FIG. 4.

FIGS. 4 and 5 illustrate another embodiment wherein a single inflatable bag 40 is so formed as to provide inflation/deflation action at the indicated phalanx and adjacent areas of the dorsum and palm of the hand. Specifically, the bag 40 comprises two like panels 41-42 of generally rectangular outline, wherein four digit openings 43-44-45-46 are in spaced transverse array at the longitudinal middle of the rectangular outline; at symmetrically located longitudinal and transverse offset from the array 43 . . . 46 are two further openings 47-48, each of which is sized for thumb accommodation. A course 49 of bonded seal extends around the entire rectangular periphery and is completed to an inflation pipe connection 50; this seal course is indicated by stippling, as is also a similar circumferentially complete seal of panels 41-42 to each other around each of the thumb and digit openings 43 . . . 48. Preferably, the panel 41 which is to be applied adjacent the skin is flock-coated for comfort, and this panel may also be porous, foraminated or punctured, for venting of pressure fluid during periods between pulsed inflations of the bag.

If the right hand is to be treated with the device of FIG. 4, then the digits are inserted through openings 43 . . . 46 with the thumb accommodated through opening 47; and if the left hand is to be treated the digits are served by the same openings while the thumb is passed through opening 48. Upon hand insertion, separate halves of the bag are folded-back to lap regions of the dorsum and palm adjacent the phalanx of the thumb and digits. Lateral edges 51-52 of the bag are then overlapped, as suggested in FIG. 5 for a left-hand situation. Adhesive tape can retain the wrapped condition while an orthopedic cast is being applied, or a circumferential tie can be established by wrapped gauze or muslin in the manner described in connection with FIG. 3. Pulsed cycles of inflation/deflation action will be seen to focus squeezing, vein-compressing local forces simultaneously around the thumb and each digit, at the phalanx and adjacent regions of the palm.

Figure 6:
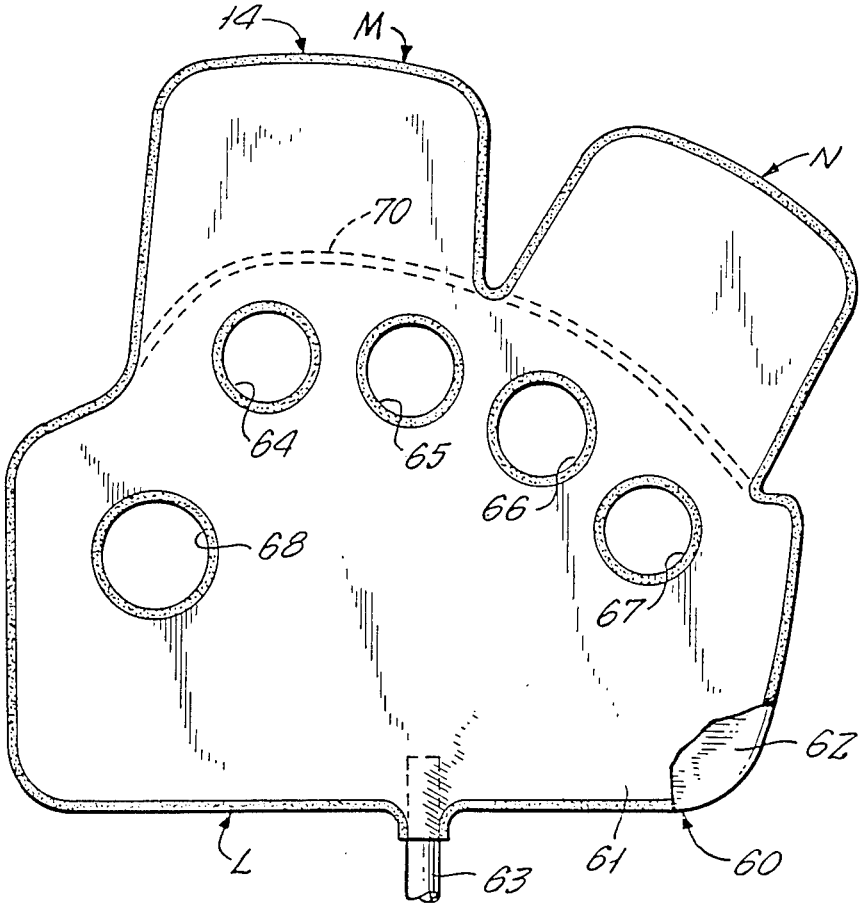
FIG. 6 is a plan view of still another inflatable embodiment in flattened condition.

The embodiment of FIG. 6 provides stimulation action similar to that afforded by the embodiment of FIGS. 4 and 5, but with greater economy of panel sheet material. Specifically, the inflatable bag 60 of FIG. 6 will be understood to comprise two like panels 61-62 of flexible sheet material which are peripherally bonded and sealed to each other and to a pressure-fluid connection 63, the course of peripheral seal being shown by stippling. Four digit openings 64-65-66-67 are in spaced slightly arcuate array, and a thumb opening 68 is at offset therefrom; and each of these openings is the site of a local circumferential seal of panels 61-62 to each other, as suggested by stippling. Peripheral profiling is characterized by a generally straight proximal edge L and by divergent lobe or tab contours M-N along the opposite edge, beyond the digit openings.

Preferably, both panels 61-62 have flock-coated outer surfaces, so that a right hand may be served by thumb and digit insertions via the panel-61 side of the bag, and so that a left hand is similarly served via the panel-62 side. Once inserted, the tab formations M-N are folded back over the dorsum of the involved hand, and adhesive tape will temporarily retain the wrapped application pending gauze, muslin and/or orthopedic-cast development of a circumferential tie.

An inflatable device of the nature described in connection with any of the present embodiments, in conjunction with its circumfrential tie, never requires a large volume change in proceeding through its inflation/deflation cycle. The maximum inflated volume is in the order of 200 cc, and on deflation the inflated volume can be expected to reduce to 75 to 100 cc. Thus, the pressure-fluid supply equipment 15 may be relatively small and convenient for table-top or shelf-mounting, with flexible-hose and disconnectable coupling to the inlet pipe (13-14, 50, 63); this is true, whether the supply and control means 15 is merely timed valving to assure programmed delivery of pressure pulses of a fluid, such as oxygen from a locally available tank supply, or the means 15 incorporates its own pumping and/or accumulator mechanism to provide the needed pressure fluid. Whatever the alternative, time-delay devices and their adjustability are all well known and therefore the supply means 15 may take on a variety of different physical embodiments. What is important, however, is that delivery of pressure fluid to the inlet (13-14, 50, 63) and the bleed of fluid through pores and/or apertures and/or valving in the deflation phase shall meet certain criteria. Presently preferred criteria will be stated in the context of FIG. 7, which shows pressure P to develop quickly in the inflation phase a and to dissipate somewhat exponentially, in the deflation phase b.

Although it has been stated above that the inflatable device is preferably inflated in one second or less, it is perhaps more accurate to state that in our experience to date the inflation should be as quick as possible, to imitate the speed with which involved veins are compressionally squeezed in a quick clenching of the fist. Such fast inflation imparts a jerk or sharply pulsed action in return-blood flow, and such action is believed to be helpful in reducing swelling and pain. It is believed that maximum velocity, however transient upon pulsed excitation, is more important than total blood flow. The veins have check-valve formations, and the downstream side of each check valve is a trap-like situs for undesired accumulation of solids or clotting which may not otherwise be flushed through the venous-return system; it is believed that with bag inflation as rapid as possible, the opening phase for each check valve is correspondingly rapid, thus locally stirring trapped return-flow blood and reducing the chances of a clotting construction of return-flow passages.

The peak pressure P for any delivered inflation impulse should be that which is sufficient to produce the appropriate venous impulse whilst not being too uncomfortable for the patient to tolerate. This will of course mean a different peak pressure P which will be various, depending upon the particular patient and his affliction. However, it can be said that, in our experience to date, a peak pressure within the inflatable device of 200 to 220-mm Hg has been satisfactory. Such peak pressure has produced comfortable actuation of the patient's hand pump, in the circumstance wherein the supply apparatus 15 has provided time-switched delivery of oxygen from a pressurized tank and, alternatively, in the circumstance wherein the supply apparatus 15 has generated its own delivery of pressurized pulses of local air; in both cases, the inflation time a was approximately 0.4 second.

The total period (a+b) of the inflation/deflation cycle will also be various, depending upon the confronting pathological condition and, in particular, on the severity of venous obstruction and on how quickly the physiological venous pump becomes filled. As a rough guide, it can be said that in severe venous obstruction, as in a limb with marked swelling, the period of the cycle might be as frequent as every 10 seconds. In moderate swelling, 30 seconds would probably be adequate, whereas for maintenance purposes a 60-second cycle should suffice. The frequency of the cycle can be audibly monitored by the clinician, listening to the flow in posterior veins of the radius or ulna with a Doppler monitor.

Although the interval between inflation pulses is very much greater than the indicated rapid inflation time a, it is our further experience that the deflation time should be as short as possible, with deflation commencing automatically at achievement of predetermined peak pressure. Thus, we currently recommend bag leakage or other inflation relief to the extent that, for example, for a peak pressure of P of 210-mm Hg, deflation to 30-mm Hg should be in about one second, and to 20-mm Hg in about 1.9 seconds. A timer within apparatus 15 reinstates the cycle upon predetermined time-out of the interval b.

Figure 7A:
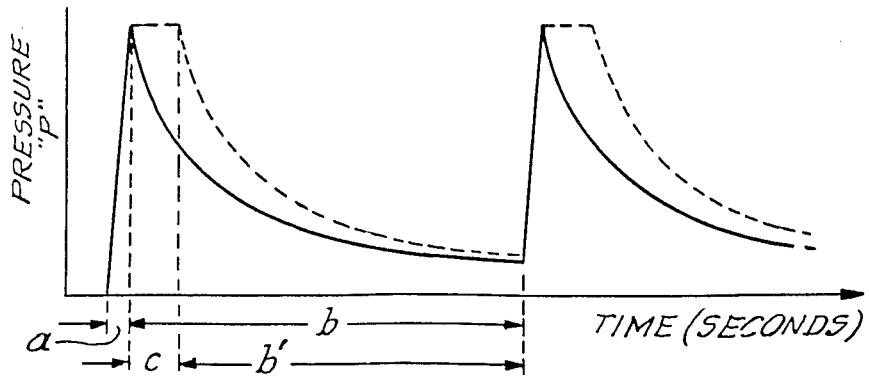

The described hand-pump activation will be seen to involve, in the interval a, a vein-compression step in which the veins of the palm/proximal-phalanges complex are compressed with resulting venous-pump action. At the same time, arterial capillaries draining into this complex are also compressed, with resultant briefly pulsed local blockage or reduction of arterial flow. When the need for venous-return action is primary, as in the a+b cycle of FIG. 7, this pulsed local blockage or reduction is so brief as to be of minor significance; in fact, the event has been noted to be followed by a measurable net transient improvement in arterial flow. But we have further discovered that, if this local compression is extended, for a period up to about five seconds, as suggested by the holding interval c in the cycle a+c+b' of FIG. 7A, a therapeutically beneficial result is obtained in arm-artery afflictions which involve ischemia from various causes, such as atherosclerosis, and diabetes that has produced arterial obstruction in an extremity. Specifically, we have found that pressure release following a holding period c of approximately three seconds produces greatest arterial-flow enhancement, which we see fit to describe as improved "throughput". The enhanced effect is discernable for maximum pressures P as low as 50-mm Hg, and the effect appears to have no relation to the patient's systolic pressure; we speculate that the effect is more likely related to local capillary pressure, which we have not thus far been able to assess. But we maximize the effect for any given patient by selecting the maximum pressure P which the particular patient can comfortably tolerate.

In any event, the rapid rise period a, in conjunction with holding period c, followed by a relaxation period b' which substantially exceeds period c (whether or not considered with the rapid-rise period a) is seen to produce venous-return action in interlacing coaction with and thus in aid of arterial-flow enhancement. In this connection, we state that the relaxation period b' should be in the range of 10 to 60 seconds, and preferably about 20 seconds.

Figure 8:
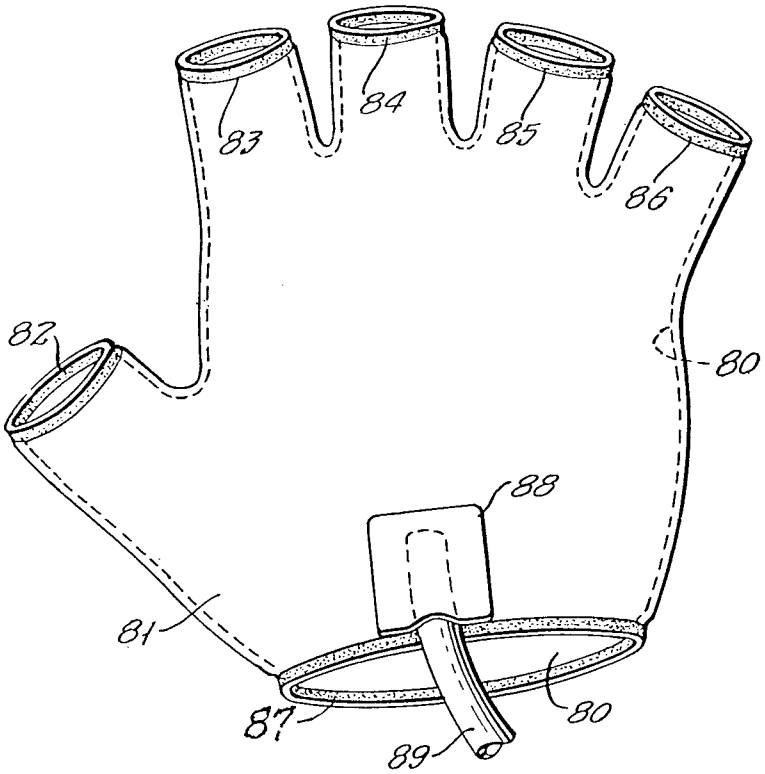

In the embodiment of FIG. 8, an inflatable mitt is provided by an inner glove 80 within an outer glove 81, the finger and thumb extremities of both gloves being truncated, to allow for installed exposure of these extremities of the hand, when the mitt is in use. These gloves are sealed to each other, via peripherally continuous seals 82-83-84-85-86 around each of the thumb and finger openings, and by another such seal 87 around the wrist opening. A reinforcement patch 88 is shown protecting the point of inflation-tube (89) entry to the bag region defined by and between the sealed gloves 80-81. If the outer glove 81 is of relatively non-stretchable material, as compared to the relatively flexible and stretchable nature of the inner glove 80, then the outer glove 81 is some cases may provide an adequate circumferential tie; generally, however, a gauze wrap as in FIG. 3 is preferred, for greater limitation of the requisite inflation volume.

Figure 9:
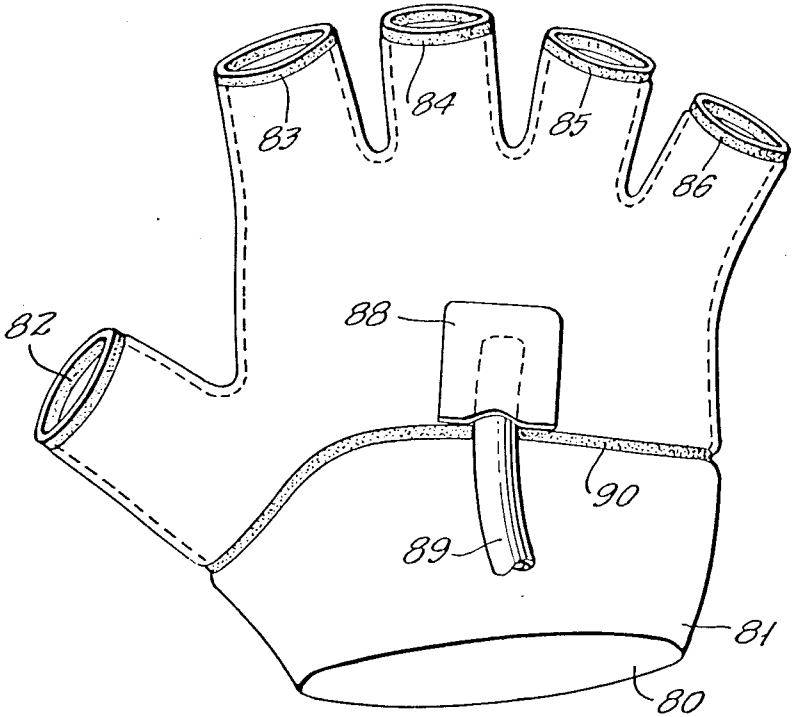
FIGS. 8 and 9 are similar views of two further inflatable embodiments of the invention.

The embodiment of FIG. 9 will be recognized for its similarity to FIG. 8, and therefore the same reference numbers have been used where appropriate. The difference in FIG. 9 is that a peripherally continuous seal 90 is developed between gloves 80-81 around the dorsum and palm, in order to further limit the requisite inflation of the device. At the proximal or wrist side of the seal 90 the gloves 80-81 may be merely laminated to each other. In both FIG. 8 and FIG. 9, inflation/deflation procedures are as described for other embodiments.

While the invention has been described in detail in connection with illustrative embodiments, it will be understood that modifications may be made without departing from the invention. For example, in the case of FIG. 6, the panels 61-62 may be bonded to each other within the entire area of tab formations M-N, i.e., outwardly of a sealed inflation perimeter which runs a course 70 suggested by phantom lines, in closely spaced distal adjacency to the digit openings 64 . . . 67. That being the case, the tab formations M-N are not part of the inflatable volume but they can be folded back over the dorsum and adhesively or otherwise integrated into the circumferential-tie development. It is to be noted that in this event, the pulse pressures are applied with at least equal effectiveness, circumferentially and individually around the proximal phalanges of the thumb and all digits, and to the adjacent region of the palm. This result is achieved without applying inflation pressure directly against the dorsum of the hand; however, in reaction to development of inflation pressure directly over the involved palm-side region, the dorsum receives an indirect application of pressure via hoop tension in the circumferential tie.

It will be seen that the described uses of the invention involve a method of and apparatus for promoting venous-pump action and/or enhancing arterial-throughput action (flow) in the arm of a living body and that, from one aspect, steps of the method comprise (a) application of a circumferential tie essentially only to that region of the palm and dorsum of the hand which is near or overlaps adjacent phalanges of the digits of the hand, (b) applying bag-inflation pressure between said region and the circumferential tie, (c) relaxing the applied pressure for a period of time which exceeds the time period of applied pressure, and (d) cyclically repeating the pressure-application and relaxation steps in a pattern wherein force-application is relatively rapid, whereby the internal sectional area of veins local to said region is rapidly reduced, with resulting venous-pump aciton throughout the entire arm. And when step (b) above is characterized by a predetermined period of sustaining the applied pressure prior to relaxation thereof, enhanced arterial thorughput is achievable in therapeutically beneficial treatment of arterial afflictions.

What is claimed is:

1. A medical appliance, comprising two inflatable bags of flexible material, each of said bags having two like panels peripherally sealed to each other and both bags being of similar peripheral contour adapted to span between lateral limits of a human hand in overlap essentially only with the proximal phalanx of all the digits and the thumb of the hand as well as adjacent regions of the palm and dorsum, with the lapped regions of the hand sandwiched between the respective bags, said bags being locally secured to each other (1) between digit-lap and thumb-lap locales and (2) at said lateral limits, thereby defining an inflatable mitt which on inflation will apply local squeezing action essentially limited to veins of said proximal phalanxes regions, said bags having means for selectively repeated admission and release of inflation pressure fluid.

2. The medical appliance of claim 1, in which the panels of each of said bags are locally secured to each other, within said peripheral contour and at the local regions where said bags are secured to each other.

3. The medical appliance of claim 1, in which said last-defined means includes a supply-tube connection to the respective bags.

4. The medical appliance of claim 1, in which the local securing of said bags to each other between digit-lap and thumb-lap locales is along alignments extending inwardly from the periphery to an extent sufficient to coextend with adjacent first phalanges.

5. The medical appliance of claim 1, in which the inner panel of each bag is characterized by plural orifices for pressure-fluid venting.

6. The medical appliance of claim 1, in which the inner panel of each bag is characterized by a napped-fiber surface for skin-contact comfort.

7. A medical appliance, comprising a single inflatable bag of flexible material, said bag having two like panels of generally rectangular peripheral contour and peripherally sealed to each other, said contour having least one dimension which is adapted to span between lateral limits of a human hand at the region of the proximal phalanx of all the digits and the thumb of the hand, said bag having a series of five individual openings distributed generally along said one dimension and inwardly spaced from the sealed periphery, said panels being continuously sealed to each other around each of said openings, said openings being of size to admit insertion of the thumb and all digits through individual openings, and said bag having means at offset from said openings for selective repeated admission and release of inflation pressure fluid.

8. The medical appliance of claim 7, in which an adjacent four of said openings are in general alignment with said one dimension and in which the fifth opening is laterally offset from said general alignment, whereby said appliance will equally accommodate thumb and digit insertion of one hand via one panel and, alternatively, thumb and digit insertion of the other hand via the other panel.

9. The medical appliance of claim 7, in which one of said panels is characterized by a napped-fiber external surface for skin-contact comfort.

10. The medical appliance of claim 7, in which one of said panels is characterized by a napped-fiber external surface for skin-contact comfort, and in which a sixth opening around which said panels are continuously sealed to each other is offset from said general alignment but in the direction of offset opposed to that of the fifth opening, whereby the skin-comfort panel of said appliance is applicable to either hand.

11. A medical appliance, comprising an inflatable bag of flexible material, said bag having two like panels peripherally sealed to each other and of peripheral contour adapted to span between lateral limits of a human hand in overlap essentially only with the proximal phalanx of all the digits and the thumb of the hand as well as adjacent regions of the palm and dorsum, and a further panel of flexible material of similar peripheral contour adapted to span between lateral limits of the hand in overlap with the proximal phalanx of all the digits of the hand as well as said adjacent regions, whereby the lapped regions of the hand may be sandwiched between said bag and said further panel, said bag and panel being locally secured to each other (1) between digit-lap and thumb-lap locales and (2) at said lateral limits, thereby defining an inflatable mitt which on inflation will apply local squeezing action essentially limited to veins of said proximal phalanges and adjacent regions, said bag having means for selective repeated admission and release of pressure fluid.

12. A medical appliance, comprising two gloves of flexible material, one in lapped fit within the other, said gloves having truncated thumb and finger formations extending distally beyond peripherally connected palm and dorsum areas, with peripherally sealed engagement of said gloves to each other around each of the truncated formations, and a peripherally continuous sealed further engagement of said gloves to each other via said palm and dorsum areas, whereby a sealed enclosure is defined by and between the sealed connections of said gloves to each other, said enclosure having means for selective repeated admission and release of pressure fluid.

13. The appliance of claim 12, in which said further sealed engagement of said gloves to each other is near the proximal edge of the palm and dorsal areas.

14. The appliance of claim 12 in which said further sealed engagement of said gloves to each other is near the distal limit of the palm and dorsal areas but at at least some offset from each of said thumb and finger formations.

15. A medical appliance, comprising circumferential-tie means adapted to peripherally envelop essentially only and to conform generally to that region of the palm of the hand which is near adjacent phalanges of the digits of the hand and distal to the wrist, a single inflatable bag adapted for retention within and by said circumferential-tie means, said bag having an active-surface portion longitudinally limited to said region and conformable to said region, and means to inflate and deflate said bag in a recurrent cycle wherein single-pulse delivery of inflation pressure is within two seconds, with deflation commencing at termination of single-pulse delivery, the deflation being for such period of time as is necessary for return of blood to the veins of the hand within said region.

16. A medical appliance, comprising circumferential-tie means adapted to peripherally envelop and to conform generally to that region of the palm and dorsum of the hand which is near adjacent phalanges of the digits of the hand and distal to the wrist a single inflatable bag adapted for retention within and by said circumferential-tie means, said bag having an active-surface portion longitudinally limited to said region and conformable to said region, and means to inflate and deflate said bag in a recurrent cycle wherein single-pulse delivery of inflation pressure is within two seconds, with deflation commencing at termination of single-pulse delivery, the deflation being for such period of time as is necessary for return of blood to the veins of the hand within said region.

17. A medical appliance, comprising circumferential-tie means adapted to peripherally envelop a region limited to (a) proximal phalanges of the digits of the hand and (b) adjacent portions of the palm and dorsum of the hand, a single inflatable bag adapted for retention within and by said circumferential-tie means, said bag having an active-surface portion longitudinally limited to said region and means to inflate and deflate said bag in a recurrent cycle wherein single-pulse delivery of inflation pressure is within two seconds, with deflation commencing at termination of single-pulse delivery, the deflation being for such period of time as is necessary for return of blood to the veins of the hand within said region.

18. A medical appliance according to any one of claims 15, 16 and 17, in which said last-defined means includes means to retain inflation of said bag for a period up to five seconds prior to commencement of deflation.

19. A medical appliance according to any one of claims 15, 16 and 17, in which said means to inflate and deflate said bag is operative in a recurrent cycle wherein single-pulse delivery of inflating pressure fluid is within one second.

20. An appliance as claimed in any one of claims 15, 16 and 17, in which said means to inflate and deflate said bag is operative in a recurrent cycle wherein single-pulse delivery of inflating pressure fluid is within the range 0.25 to 1.0 second.

21. A medical appliance comprising a circumferentially tying inflatable bag shaped for radially inward active engagement solely with a human hand and substantially only in the region of the palm of the hand exclusive of the arm and the extremities of the digits and thumb, and cyclically operable automatic means for delivering fluid pressure within said bag in accordance with the following criteria:

(a) a pressure rise to a predetermined maximum of 220-mm Hg or less within less than two seconds;

(b) holding said maximum for a period up to five seconds before dropping the pressure; and (c) repeating pressure delivery pursuant to criteria (a) and (b) at a periodic interval which is in the range up to 60 seconds.

22. A medical appliance comprising a circumferentially tying inflatable bag shaped for active radially inward active engagement solely with a human hand and substantially only in the region, of the palm of the hand exclusive of the arm and the extremities of the digits and thumb, and cyclically operable automatic means for delivering fluid pressure within said bag in accordance with the following criteria:

(a) a pressure rise to a predetermined maximum of 220-mm Hg or less within less than two seconds;

(b) dropping the pressure upon attainment of said predetermined maximum; and (c) repeating pressure delivery pursuant to criteria (a) and (b) at a periodic interval which is in the range up to 60 seconds.

23. The appliance of claim 21 or claim 22, wherein the time duration for criterion (a) is less than one second.

24. The appliance of claim 21 or claim 22, wherein the time duration for criterion (a) is in the range 0.25 to 1.0 second.

25. The appliance of claim 21 or claim 22, wherein said predetermined maximum pressure is in the range 50 to 200-mm Hg.

26. The appliance of claim 21 or claim 22, in which the drop in pressure from said maximum is to substantially one tenth of said maximum.

27. The appliance of claim 21 or claim 22, in which the period of dropped pressure prior to repeating pressure delivery is approximately 20 seconds.

* * * * *